US005273007A

United States Patent [19]

Ampferer

[11] Patent Number: 5,273,007

[45] Date of Patent: Dec. 28, 1993

[54] ARRANGEMENT FOR DISTRIBUTING OIL IN A CAMSHAFT

[75] Inventor: Herbert Ampferer, Sachsenheim, Fed. Rep. of Germany

[73] Assignee: Dr. Ing. h.c.F. Porsche AG, Fed. Rep. of Germany

[21] Appl. No.: 955,722

[22] PCT Filed: Jun. 15, 1991

[86] PCT No.: PCT/EP91/01112

§ 371 Date: Feb. 17, 1993

§ 102(e) Date: Feb. 17, 1993

[87] PCT Pub. No.: WO91/19887

PCT Pub. Date: Dec. 26, 1991

[30] Foreign Application Priority Data

Jun. 21, 1990 [DE] Fed. Rep. of Germany ..... 4019766

[51] Int. Cl.[5] ..... F01L 9/10; F01M 11/00; F01M 11/02

[52] U.S. Cl. ..... 123/90.34; 123/90.6; 74/567

[58] Field of Search ..... 123/90.33, 90.34, 90.6, 123/90.17; 74/567

[56] References Cited

U.S. PATENT DOCUMENTS

| | | | |
|---|---|---|---|
| 4,949,683 | 8/1990 | Swars | 123/90.34 |
| 5,186,129 | 2/1993 | Magnan et al. | 123/90.34 |
| 5,201,247 | 4/1993 | Maus et al. | 123/90.34 |

FOREIGN PATENT DOCUMENTS

| | | | |
|---|---|---|---|
| 0275715 | 7/1988 | European Pat. Off. . | |
| 542494 | 8/1922 | France . | |
| 37552 | 3/1980 | Japan | 123/90.34 |
| 2153006 | 8/1985 | United Kingdom . | |
| 2156485 | 10/1985 | United Kingdom . | |

*Primary Examiner*—E. Rollins Cross
*Assistant Examiner*—Weilun Lo
*Attorney, Agent, or Firm*—Evenson, McKeown, Edwards & Lenahan

[57] ABSTRACT

An arrangement for distributing oil in a camshaft of an internal-combustion engine comprises a cylindrical insert which extends axially in the camshaft and carries two separate oil flows in the camshaft. The insert has a centrally arranged oil duct for one oil flow and a hollow space for another oil flow which is constructed between the insert and the camshaft and forms a portion of the arrangement. Both oil flows are fed to the camshaft or discharged from it by way of radial ducts.

3 Claims, 3 Drawing Sheets

ARRANGEMENT FOR DISTRIBUTING OIL IN A CAMSHAFT

The invention relates to an arrangement according to the preamble of claim 1.

From the FR-A-54 29 94, an arrangement for distributing oil in a camshaft of an internal-combustion engine is known in which the bearing points for the camshaft are connected to an oil circulating system and a cylindrical insert extends axially inside the camshaft and bounds a hollow space between the camshaft and this insert and has a centrally extending oil duct.

By means of this arrangement, one and the same oil flow can be guided inside the oil duct to remote lubricating points and can be guided inside the hollow space to close lubricating points.

The invention is based on the object of providing an arrangement for the distribution of oil in a camshaft which makes it possible to guide several oil flows in the camshaft independently of one another.

This object is achieved by means of the characteristics of claim 1. Advantageous developments of the invention are indicated in the subclaims.

This arrangement for the distribution of oil permits the targeted guiding of a first and a second oil flow inside a camshaft. In this case, the oil flows are completely separated from one another and may therefore have different pressures, flow rates, flow directions, etc.

The oil duct, which is arranged centrally in the insert, by way of a first radially extending duct, is connected to the oil circulating system and carries a first oil flow, for example, from one end to the camshaft to one or to several bearing points. The oil duct is coaxially enclosed at least in sections by a circular hollow space which extends between the insert and the camshaft. In this hollow space, a second oil flow is carried which is connected to the oil circulating system by way of a second duct.

Between a first and a second duct, the insert has a first sealing section which axially bounds the hollow space on one side and separates the oil flows from one another.

Advantageously, the arrangement is suitable for various applications. Thus, for example, from one end of the camshaft, two oil flows may be fed into the oil duct or the hollow space in order to ensure, by way of the first duct, the lubricating of bearing points while, by means of the second duct, hydraulically connectable and disconnectable cams are operated.

In a further application, the arrangement may be used for actuating a hydraulically operated phase converter. In this case, the phase converter changes the relative rotating position between the inlet camshaft and the outlet camshaft of an internal-combustion engine by means of an axial displacement of a control piston in two end positions. According to the displacement direction of the control piston, a pressurized-oil flow is fed through one of the ducts into the camshaft, while the unpressurized oil volume displaced by the control piston is discharged by way of the second duct.

The insert may be made of plastic to be light in weight, cost-saving and insensitive to tolerances. It is pressed into the camshaft with a slight overdimension.

For avoiding transversal vibrations of the insert in the camshaft, it is provided in the area of the hollow space with ribs which are arranged between the oil duct and the inner surface of the camshaft and which divide the hollow space into several oil grooves.

The first sealing section consists of several radially acting sealing elements which effectively separate the oil flows from one another and prevent vibrations of the insert in this area.

An embodiment of the invention is explained in detail by means of figures.

Figure 1:
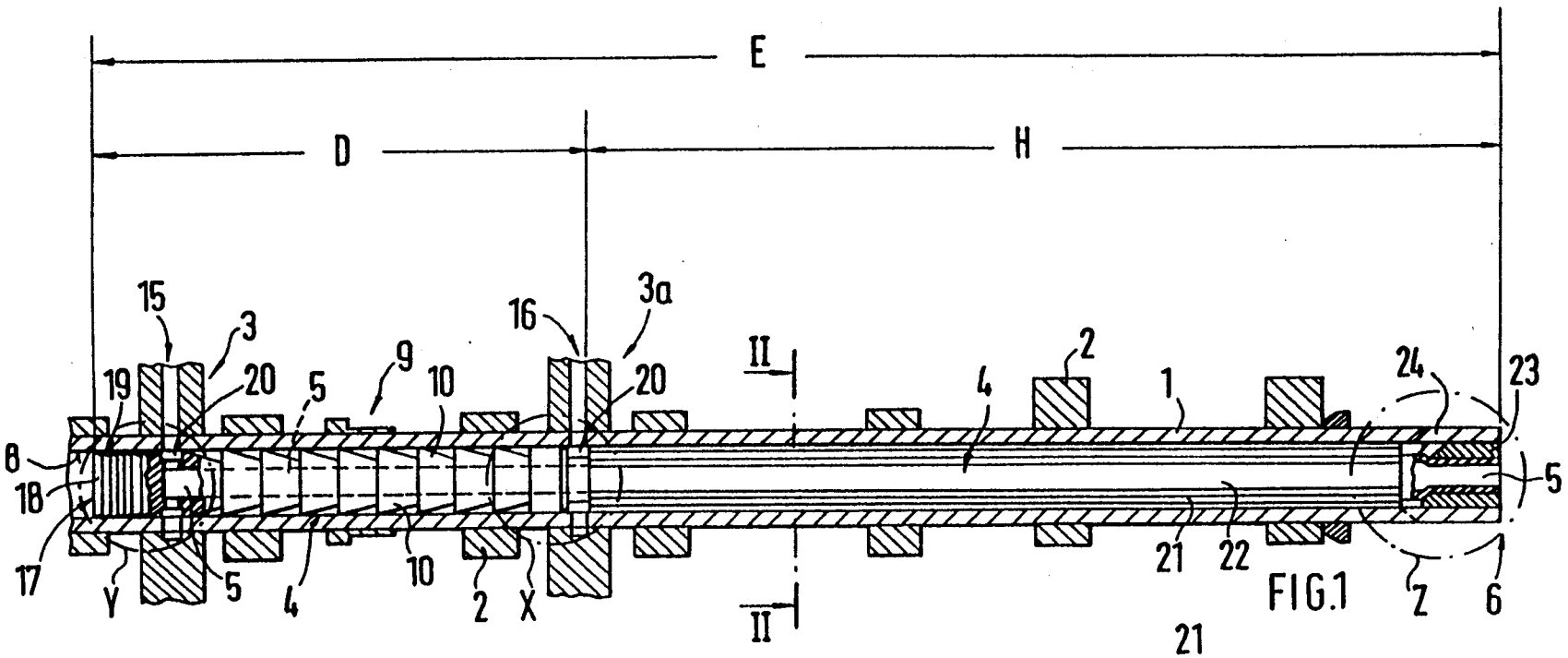
FIG. 1 is a partial sectional view of an arrangement.

A hollow constructed camshaft 1 of an internal-combustion engine, which is not shown, has cams 2 for the operating of lift valves, which are also not shown, and is held in several bearing points 3. Along a section E, inside the camshaft 1, an axially extending insert 4 is provided in which a centrally extending oil duct 5 is arranged which extends from an open end 6 of the camshaft 1 to close to the opposite end of section E.

From the end 6, the oil duct 5 is coaxially surrounded along a section H by a hollow space 7 which is constructed between the oil duct 5 and the inner surface 8 of the camshaft 1.

In a section D, which remains between section E and section H, the insert 4 has a first sealing section 9 which consists of several axially spaced, radially acting sealing elements 10.

By way of a radially extending first duct 15, the oil duct 5 is connected with a first bearing point 3 which is connected to an oil circulating system of the internal-combustion engine which is not shown.

By way of a radially extending second duct 16, the hollow space 7 is connected adjacent to the sealing section 9 with a second bearing point 3*a* which is also connected to the oil circulating system.

On the end 17, which is situated opposite the end 6, the insert 4 has a cover 18 which closes off the oil duct 5 and which, together with the adjacent portion of the insert 4, forms a second sealing section 19. Adjacent to the first duct 15, the sealing sections 9 and 19 are designed such that a ring gap 20 which encloses the oil duct 5 coaxially remains between them and the inner surface 8.

Along section H, ribs 21 are arranged which project radially from the oil duct 5 and support the insert 4 in the area of the hollow space 7 with respect to the surface 8 and thus prevent vibrations of the insert 4 in the camshaft 1.

Figure 2:
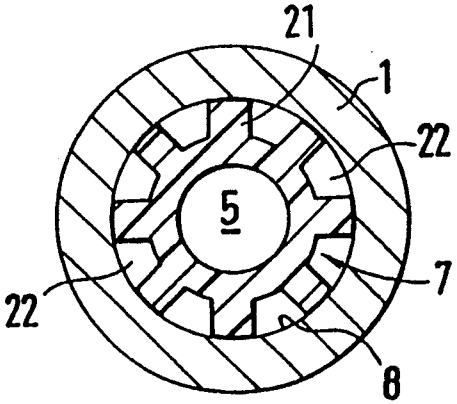
FIG. 2 is an enlarged sectional view along Line II—II according to FIG. 1.

According to FIG. 2, the ribs 21 divide the hollow space 7 into axially extending oil grooves 22. Adjacent to the second duct 16, the first sealing section 9 and the hollow space 7 are designed such that another ring gap 20 remains between them and the inner surface 8 and coaxially encloses the oil duct 5.

Figure 6:
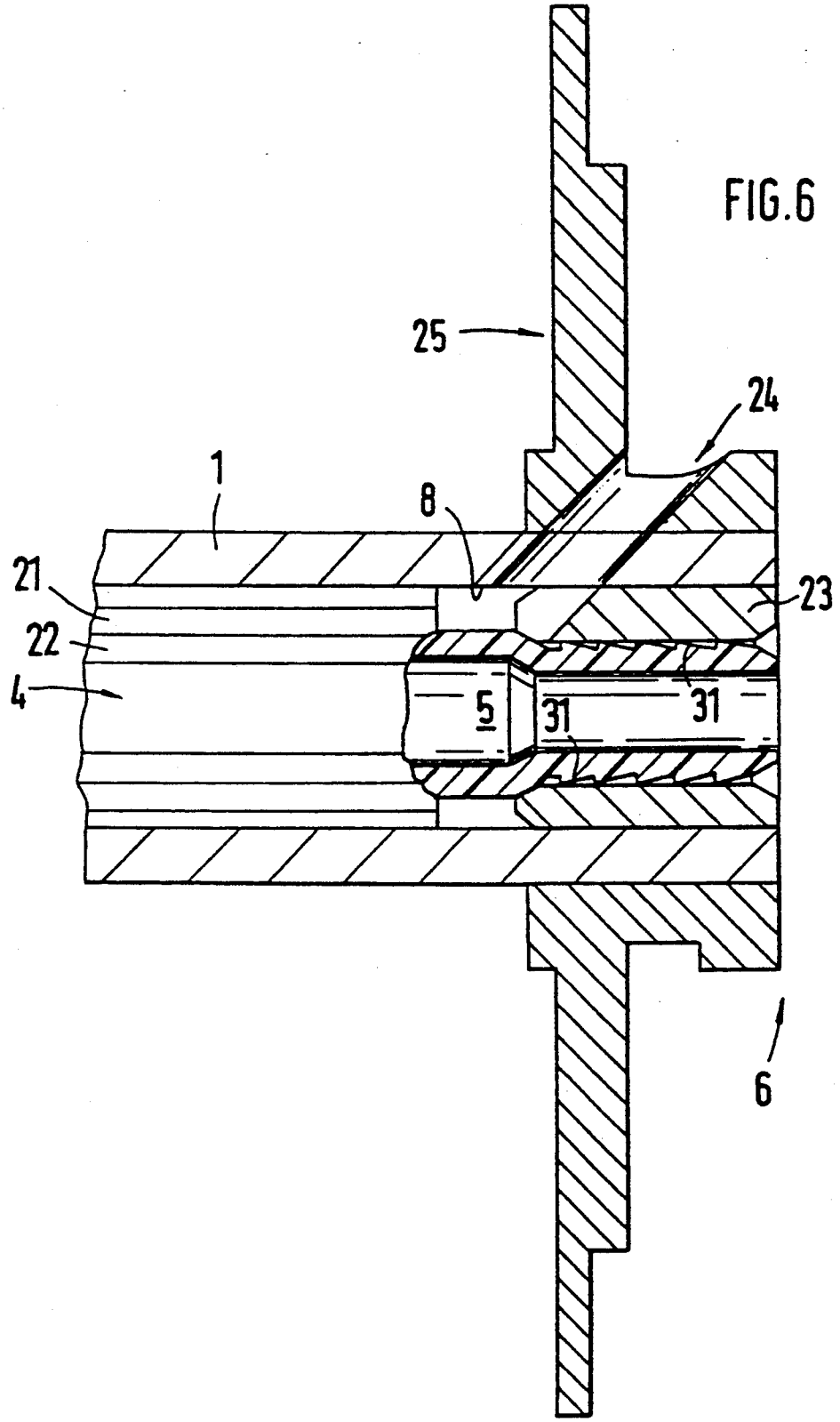
FIG. 6 is an enlarged view of a detail Z according to FIG. 1.

On the front end 6 of the camshaft 1, a bushing 23 is pressed in in an oiltight manner which accommodates the oil duct 5 and bounds the hollow space 7 in such a manner that the oil flowing in it arrives from a bore 24 of the camshaft 1 according to FIG. 6 in a phase converter 25 which is not shown in detail.

Figure 3:
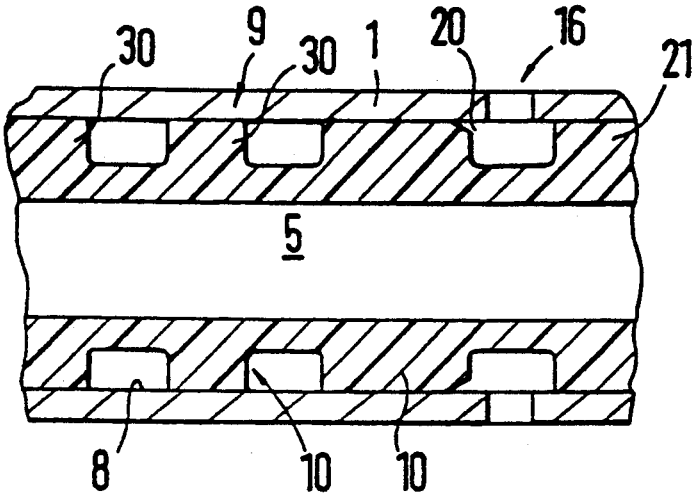
FIG. 3 is an enlarged view of a second embodiment of a detail X according to FIG. 1.
Figure 4:
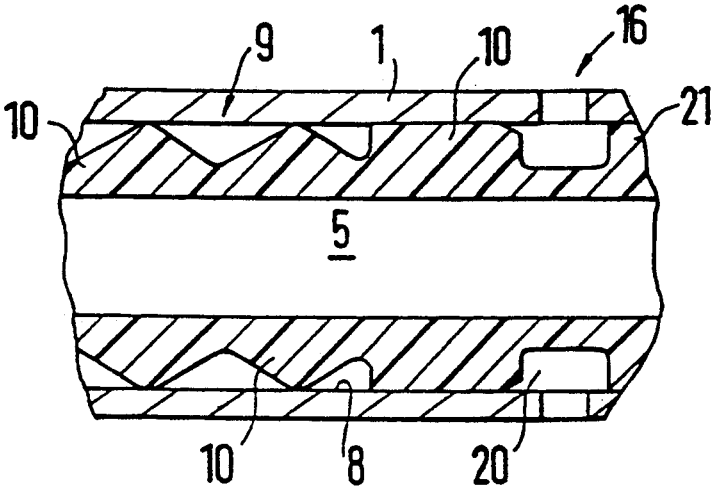
FIG. 4 is an enlarged view of a third embodiment of a detail X according to FIG. 1.
Figure 5:
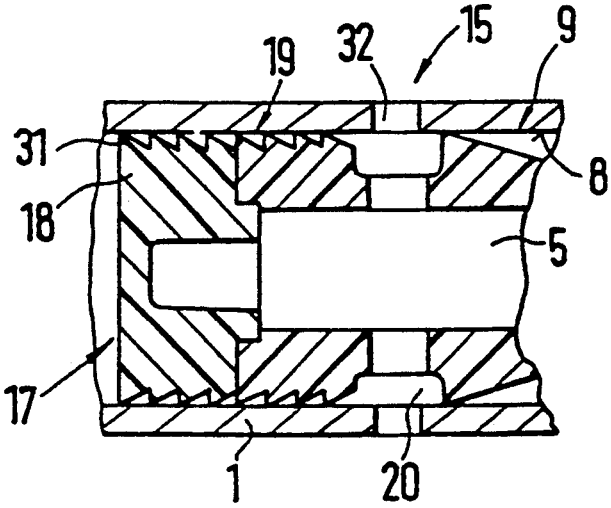
FIG. 5 is an enlarged view of a detail Y according to FIG. 1.

According to FIG. 1, the sealing elements 10 of the sealing section 9 are constructed in the manner of a truncated cone but, according to a second embodiment (FIG. 3), may also be constructed of cylindrical rings 30 or may, according to a third embodiment (FIG. 4), be shaped in the manner of a bead. In all embodiments, the sealing element 10 which is adjacent to the second duct 16 has a cylindrical design.

The second sealing section 19 and the portion of the oil duct 5 disposed in the bushing 23 have surrounding sealing lips 31.

In a simple manner, the insert 4 may be manufactured from a filled plastic material, such as PA66 GF35, in which case the cover 18 is mounted by means of ultrasonic welding.

During the mounting, the complete insert 4 is slid into the camshaft 1 in such a manner that the oil duct 5, on its end 6, closes off flush with the camshaft 1; then the bushing 23 is pressed in.

During the operation of an internal-combustion engine equipped with the arrangement, pressurized oil is fed into the ring duct 20 by way of a bore 32 in the camshaft 1 which forms a portion of the first duct 15, which pressurized oil arrives in the phase converter 25 through the oil duct 5. From an oil circulating system, this oil is fed to the internal-combustion engine by way of the first bearing point 3. In this case, unpressurized oil is carried from the phase converter 25 by way of the bore 24 into the oil grooves 22 and is returned into the oil circulating system by way of the second duct 16 and the second bearing point 3.

When the phase converter is actuated again, the pressurized oil is guided by way of the second bearing point 3 into the oil grooves 22; the unpressurized oil flows in the oil duct 5 from the phase converter 25 to the first bearing point 3.

What is claimed is:

1. An arrangement for distributing oil in an internal-combustion engine camshaft (1), comprising bearing points (3, 3a) for the camshaft (1) connected to an oil circulating system and a cylindrical insert (4) extending axially within the camshaft (1), bounding a hollow space (7) between the camshaft (1) and the insert (4) and having a centrally extending oil duct (5), wherein the oil duct (5) is arranged to carry a first oil flow and is connected, via a first duct (15) in a first (3) of the bearing points (3, 3a) with the oil circulating system, the insert (4) is coaxially surrounded at least in sections by the hollow space (7) arranged to carry a second oil flow and connected, via a second duct (16), to the oil circulating system, and the insert (7), between the first duct (15) and second duct (16), has a sealing section (9) which axially bounds the hollow space (7), acts radially and is provided with several axially spaced sealing elements (10), the insert (4) having on each side of the sealing section (9) one ring gap (20) which coaxially encloses the oil duct (5) adjacent to the first and second ducts (15, 16) and the second duct (16) is connected with the oil circulating system via a second of the bearing points (3a).

2. The arrangement according to claim 1, wherein the insert (4), in the area of the hollow space (7), has radially projecting ribs (21) supporting the insert (4) in the camshaft (1).

3. The arrangement according to claim 1, wherein the insert (4), adjacent first duct (15), has a second radially acting sealing section (19).

* * * * *